United States Patent [19]

Johnston

[11] Patent Number: 4,566,819

[45] Date of Patent: Jan. 28, 1986

[54] CLAMP FOR SHORING AND SCAFFOLDING FRAMES

[75] Inventor: Ronald J. Johnston, Georgetown, Canada

[73] Assignee: Aluma Systems, Incorporated, Downsview, Canada

[21] Appl. No.: 353,424

[22] Filed: Mar. 1, 1982

[51] Int. Cl.[4] ..... F16B 7/00

[52] U.S. Cl. ..... 403/385; 403/400

[58] Field of Search ..... 403/385, 389, 394, 400

[56] References Cited

U.S. PATENT DOCUMENTS

| | | | |
|---|---|---|---|
| 1,706,801 | 3/1929 | Merrill | 403/385 |
| 2,101,317 | 12/1937 | Lemieux | 403/385 X |

FOREIGN PATENT DOCUMENTS

| | | | |
|---|---|---|---|
| 132027 | 11/1947 | Australia | 403/385 |
| 935022 | 11/1955 | Fed. Rep. of Germany | 403/385 |
| 934577 | 1/1948 | France | 403/385 |
| 1099331 | 3/1955 | France | 403/385 |
| 340724 | 1/1931 | United Kingdom | 403/385 |
| 741634 | 12/1955 | United Kingdom | 403/385 |

*Primary Examiner*—Andrew V. Kundrat

*Attorney, Agent, or Firm*—Arnold, White & Durkee

[57] ABSTRACT

A clamp arrangement for use in interconnecting structural members such as those used in scaffolding and shoring framework comprises two clamps which can be interconnected for either rotation between the clamps or fixed positioning of the clamps in at least one predetermined position. The clamps in the area of interconnection have portions which are adapted to be secured to position the clamps in the corresponding predetermined fixed relative position. A securing device cooperates with the clamp portions for securing them to fix the clamps in the corresponding predetermined relative position.

55 Claims, 18 Drawing Figures

CLAMP FOR SHORING AND SCAFFOLDING FRAMES

FIELD OF THE INVENTION

This invention relates to clamps and clamp arrangements for use in interconnecting structural members and more particularly to clamps which have the facility for either unrestricted relative rotation or one or more fixed relative positions.

BACKGROUND OF THE INVENTION

Clamps are used in many areas for interconnecting structural members in the mechanical assembly of components. Clamps may be used in the positioning of light fixtures, on laboratory equipment and on scaffolding and shoring frames used in construction, to name only a few. With particular reference to the construction field, several arrangements of clamps have been developed over time which are particularly suited for clamping tubes and the like to shoring and scaffolding frames in assembling the framework so as to support the frames in forming columns and the like. Normally such clamps are designed to clamp one circular tube to another circular tube where the clamps are fixedly secured to one another. This is usually accomplished by having common clamp jaws integrally formed. Examples of such clamps are disclosed in U.S. Pat. No. 1,706,214 and U.S. Pat. No. 2,194,883. These patents are representative of scaffolding clamps which are fixed to clamp one tubular member at 90 degrees or at 45 degrees relative to the other tubular member.

There are however situations where in clamping one structural member to another their angular relationship may not always be that defined by a particular fixed clamp arrangement. Thus swivel interconnections having unrestricted relative rotation between the clamps were devised to accommodate variations in angular relationships between the members to be clamped. The difficulty with a swivel-type clamp is that in not fixing the relative positions of the members, the assembled structure may permit some movement and is therefore somewhat weaker for supporting loads. Examples of swivel-type clamps are disclosed in U.S. Pat. No. 2,945,713, Australian Pat. No. 152,133 and Canadian Pat. No. 369,685. The Australian Patent discloses that the swivel connection can be fixed by simply welding the components together to provide the fixed arrangement. Also in Canadian Pat. No. 369,685 alternative configurations are shown for fixed interconnections which is similar to that disclosed in U.S. Pat. No. 1,706,214.

Attempts have been made to provide a type of clamp arrangement which has the advantages of swivelling between the clamps and provision for fixing the relative positions for the clamps. Examples of such clamps are disclosed in U.S. Pat. No. 1,706,215 and Canadian Pat. No. 356,357. The clamp arrangement of U.S. Pat. No. 1,706,215 may be swivelled to a desired position with the ratchet teeth separated and then upon meshing the teeth and tightening a bolt to secure the meshed ratchet teeth, a desired fixed positioning of the clamps is achieved. With Canadian Pat. No. 356,357 the clamps may swivel relative to one another through a distance predetermined by the arcuate slot in one clamp body portion. Upon tightening of the bolt the clamps are fixed in a desired position. In this arrangement the distribution of loads for the device in fixing the clamps' positions is offset from the central axis about which the clamps can rotate. This unequal distribution of the loads does not provide for a secure clamp interfit and can result in failure of the clamps when placed under load. Secondly, the clamp does not offer a full swivel of the interconnected clamps without restriction.

With the ratchet tooth arrangement of U.S. Pat. No. 1,706,215, the teeth are separated to provide for relative rotation between the clamps. The interconnection for the clamps has not, however, been adapted in any way to maintain separation between the teeth for rotation. Instead the interconnection is such that the teeth of the ratchet arrangement are meshed when the clamp is in use. To withstand the loads which may be exerted on the clamp, the teeth should be constructed of a harder metal, such as steel. Thus care in design must be exercised when the arrangement is made of less hardenable metals.

The clamp arrangement according to this invention overcomes the above problems in providing an interconnection for clamps which is adapted to give either rotation between the clamps or positioning of the clamps in at least one predetermined fixed relative position.

SUMMARY OF THE INVENTION

The clamp arrangement, according to this invention, is interconnected in a manner to provide for either rotation between the clamps or positioning of the clamps in at least one predetermined fixed relative position. Such interconnection is provided by at least one portion of at least one clamp in the area of clamp interconnection which is adapted to be secured to position the clamps in the at least one fixed relative position. Means cooperates with and contains the clamp portion for securing it in its relative position. The connection may be completed in a manner to balance the distribution of stresses on this securing means about the axis of interconnection when the clamp arrangement is under load.

More particularly the invention is embodied in a clamp having a clamp body which is releasably closeable to surround and clamp a structural member. The clamps in their area of interconnection have opposing portions which have a distinct relative orientation at each of the at least one predetermined fixed relative positions for the clamps. Means is provided for engaging said opposing portions when they are in each said distinct relative orientation to lock said portions and thereby provide the corresponding predetermined fixed relative positions for said clamps.

According to an embodiment of the invention the opposing portions of the clamps are matched and have external surfaces which are symmetrical about the axis of interconnection for the clamps.

According to another variation of the invention the matched portions for the clamps are in the form of non-circular apertures defined in each clamp body. The internal surfaces of each aperture are symmetrical about the longitudinal axis of the aperture. The clamps are interconnected with the longitudinal axes of the apertures coincident. The locking means is adapted for insertion in the apertures and bridges same to engage aligned internal surfaces to position the clamps in a corresponding fixed relative position.

The invention is also embodied in the securing means being integral with one or both of the clamps. One of the clamps may have an external shoulder arrangement which is engaged by the securing means integral with the other clamp, which may be in the form of a ridge arrangement which engages and contains the shoulder arrangement. Alternatively, the securing means may be formed on both clamps and arranged on each clamp to cooperate with and engage a corresponding opposing portion on the other clamp. In this alternative, the securing means may comprise at least one ridge integral with each clamp adapted for engaging a corresponding shoulder portion on the other clamp.

The clamp arrangment may also be adapted for interconnecting at least two clamps all along a common axis about which the clamps can rotate relative to one another. Thus each clamp jaw has on its exterior between its hinge point and its free end a shoulder means arrangement which is symmetrical about the axis and which cooperates with a similar shoulder means arrangement on an adjacent clamp jaw. The shoulder arrangements determine when aligned, at least one fixed relative position for adjacent clamps. Means cooperates with and engages the aligned adjacent shoulder means to secure them and thereby provide the corresponding fixed relative position for the adjacent clamps.

The clamps are particularly suitable for use with a scaffolding and shoring framework such as framework made of aluminum alloys as disclosed in co-pending U.S. Patent Application Ser. Nos. 231,778 filed Feb. 5, 1981 and 249,732 filed Mar. 31, 1981. The clamps may be formed of aluminum alloy where the clamps may be individually formed from an extruded section of aluminum alloy.

BRIEF DESCRIPTION OF THE DRAWINGS

Preferred embomiments of the invention are shown in the drawings wherein.

DETAILED DESCRIPTION OF THE PREFERRED EMBODIMENTS

The clamp arrangement according to this invention can be used to connect structural members of the same or different configuration at any angular relationship as provided for by rotating the clamps to the desired position or any desired angular relationship in a fixed manner. As will be learned from the description of the preferred embodiments, various approaches may be taken in providing for such clamp interconnection as dependent upon the uses the clamps will have in various configurations. To better understand the invention, the clamp arrangement is described with respect to use in scaffolding and shoring framework, however, it is understood that the invention is also embodied in other clamp arrangements as previously defined such as laboratory clamping equipment, shelving clamping equipment, light fixture clamping equipment, etc.

Figure 1:
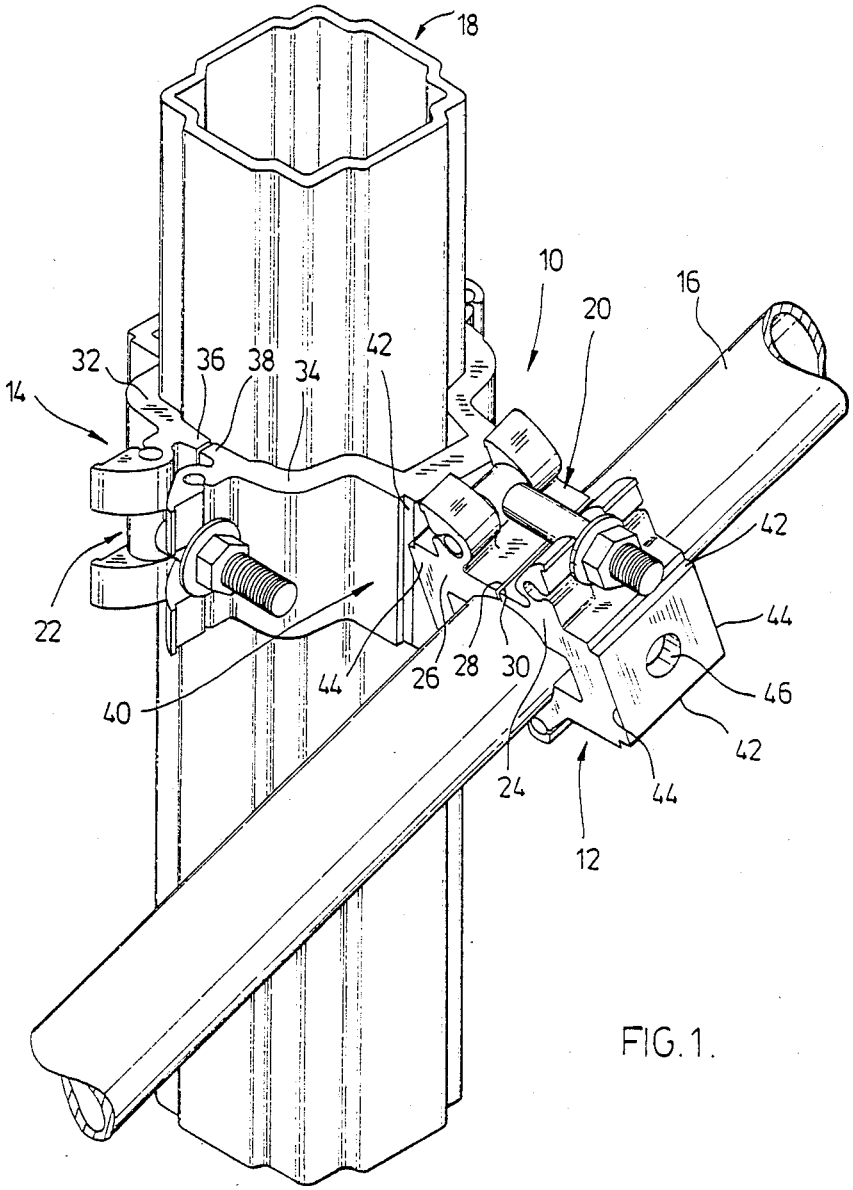
FIG. 1 is a perspective view showing a tubular brace connected tubular leg by a clamp arrangement according to a preferred embodiment of the invention.

The clamp 10 as shown in FIG. 1 is interconnected so as to provide for swivel or relative rotation between the interconnected clamp bodies 12 and 14. The clamps interconnect round tubular member 16 to a somewhat square or rectangular member 18. In the scaffolding and shoring field member 18 may be a leg of a frame and structural member 16 may be a length of tube used to interconnect and steady a frame leg. Each clamp 12 and 14 is provided respectively with clamp closure devices 20 and 22 which squeeze the clamps around the respective structural member 16 and 18 so as to grip the structural members to effect a secure clamped interconnection. To prevent crushing or over clamping of the structural members the clamp jaws 24 and 26 of clamp 12 may be provided with opposing abutments 28 and 30 which prevent overtightening in clamping the tube 16. Similarly with clamp 14, clamp jaws 32 and 34 have opposing abutment portions 36 and 38 which also prevent overclamping and crushing of the frame leg 18. This is advantageous in instances where the structural members 16 and 18 are made of materials which can be crushed such as tubing of plastic or reinforced plastic or fiberglass or thin wall metal tubing for both the members 16 and 18.

As shown in FIG. 1, the clamps 12 and 14 are free to rotate relative to one another to allow positioning of the brace member 16 at any desired angular relationship relative to the frame leg 18. Once the clamps are secured to the leg and the brace is secured at the other end, the clamp position remains relatively unchanged.

In the area 40 of interconnection, matched portions are provided in the form of shoulders 42 and 44 of the adjacent clamp body jaws 26 and 34. Although the shoulders 42 and 44 are shown as being planar, it is appreciated that the shoulders may take on other shapes, particularly between the corners, as will be apparent when the locking device for the shoulders is discussed in respect of the other embodiments. As is more clearly shown on the clamp jaw body 24, the shoulders 42 oppose one another and shoulders 44 oppose one another as symmetrically distributed about the aperture 46 of clamp jaw 24, whose axis is coincident with the axis of rotation of the clamps 12 and 14. As can be appreciated from FIG. 1, upon relative rotation of the clamps 12 and 14, the shoulders of the matched portions in the area of interconnection become aligned to define in this instance two distinct relative positions of the clamps 12 and 14. These two distinct positions are at 0 degrees, that is the tubular members would be parallel to one another and 90 degrees where member 16 would be at right angles relative to the frame leg 18.

Figure 2:
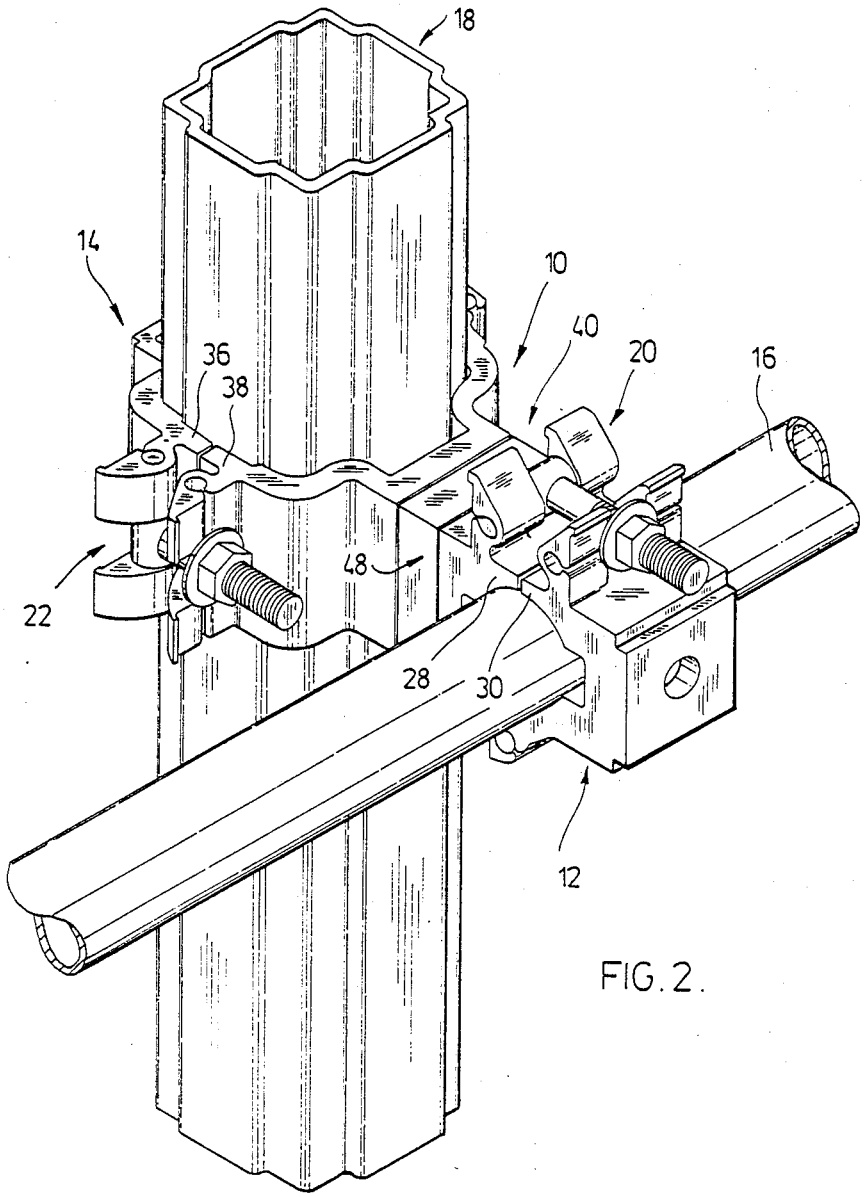
FIG. 2 is a perspective view of a tubular brace clamped to a tubular leg in a fixed position by a clamp arrangement according to a preferred embodiment of the invention.
Figure 3:
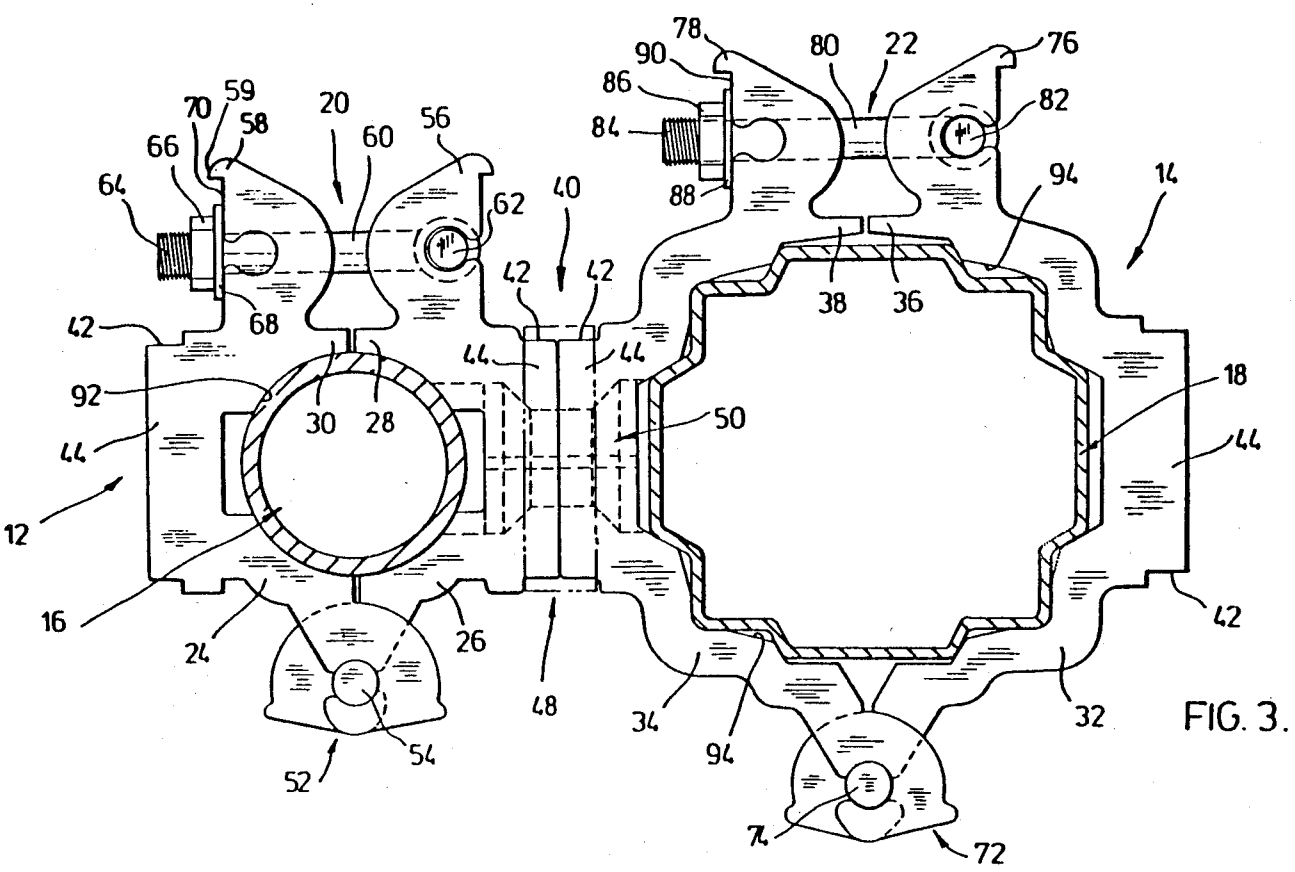
FIG. 3 is a top plan view showing the clamp arrangement interconnecting two tubular members in parallel relationship.

Turning to FIGS. 2 and 3, the clamp arrangement 10 is in one of its fixed relative positions where the tubular brace member 16 is at 90 degrees to the frame leg 18. The shoulders 42 and 44 of the area of interconnection 40 are aligned and a locking means or securement device 48 is provided to engage amd contain the aligned shoulders and secure them in the position shown to fix the relative positions of clamps 12 and 14. This arrangement of the abutment portions may be useful in the field to visually indicate to the workman by a narrow space or no space between the abutments the degree of tightness of the clamp on a member. In using the locking device 48, the position of tubular member 16 is fixed relative to the leg 18 within the limits of load that the locking device 48 will withstand when the entire framework is under load. The particular arrangement of the securement device 48 relative to the matched aligned shoulder portions will be discussed in more detail with respect to FIG. 3. As can be seen from FIG. 2, the closure devices 20 and 22 are firmly secured such that the abuting portions 28 and 30 of clamp 12 and abuting portions 36 and 38 of clamp 14 are proximate so as to provide a secure clamping of the tubular member 16 relative to the frame leg 18.

The clamps 12 and 14 are secured by the securement device 48 in the 0 degree position where the frame leg 18 is parallel to the tubular brace 16. In this arrangement the opposing matched portions in the area of interconnection 40 are aligned as shown by the arrangement of shoulders 42 and 44. The locking or securement device 48 is, according to this embodiment, a collar having an interior outline corresponding to the shape of the shoulders when aligned. Since in this embodiment the shoulders 42 and 44 are all of equal length, the interior configuration of the collar 48 is that of a square and dimensioned so as to snugly receive and engage the shoulders 42 and 44 as shown. In the area of interconnection 40 the adjacent clamp jaws 26 and 34 of interconnected clamps 12 and 14 are secured together by a bolt and nut arrangement shown generally in dot at 50. The longitudinal axis of the bolt and nut arrangement 50 is coincident with the axis of relative rotation of the two clamps 12 and 14. The bolt arrangement 50 holds the adjacent clamp jaws together and with the collar snugly engaging the aligned shoulders 42 and 44, the clamps 12 and 14 are not permitted to rotate relative to one another thus providing the fixed relative position of the clamps 12 and 14.

As is apparent from FIG. 3, when the frame leg 18 and the cross bracing 16 are under load, forces would be exerted to attempt to rotate one clamp relative to the other about the axis of the bolt 50. This is resisted by the locking collar 48 which would be placed principally under tension as the shoulders attempt to stretch and deform the locking collar 48. Because the shoulders 42 and 44 are symmetrical or evenly distributed about the axis of rotation, then the loads applied to the interconnection are thus evenly distributed about the axis of rotation. Therefore, there are no high stresses exerted on the locking device in any one area offset from the axis of rotation. Instead they are evenly distributed about the axis of rotation as counteracted by the locking collar 48 to provide for a more secure interconnection of the clamps when providing for the corresponding fixed relative position for the clamps 12 and 14.

Clamp 12 has clamp jaw portions 24 and 26 which at one end are pivotally interconnected by hinge 52 about pivot pin 54. The free ends 56 and 58 of the clamp jaws are adapted to cooperate with the closure device 20. Closure device 20 consists of a bolt portion 60 which is pivotally connected to clamp jaw free end 56 at 62. The other end of the bolt is threaded at 64 to receive nut 66. With the nut sufficiently out on the bolt thread, the bolt can be swung so as to clear free end 58. With the bolt removed from the free end 58, the clamp jaw 24 may lay open relative to clamp jaw 26 to permit positioning of the structural support or cross member 16 in the clamp 12. The hinge 52 may be adapted to hold jaw 24 at 90 degrees relative to jaw 26 when the clamp is open to permit placement of brace 16 on the open jaw. By moving the clamp jaw 24 toward the closed position, the bolt 60 may be swung inwardly with the nut 66 and washer 68 clearing the free end 58 and thereby permitting tightening of the nut 66 against the face 70 of free end 58 to clamp the tubular member 16 in the clamp 12. The free end 58 is provided with a lip 59 to prevent the washer slipping off the flat 70 as the nut is tightened. As previously explained, abutment portions 28 and 30 limit the the tubular member.

Similarly with clamp 14, it comprises two clamp jaws 32 and 34 which are hinged at 72 about a hinge pin 74. The free ends 76 and 78 are adapted to cooperate with the securement means 22 which has a bolt 80 pivotally connected to free end 76 at 82 and threaded at its other end at 84 to recieve a nut 86. As with clamp 12 and the leg member 18 within the clamp, the connector device 22 may be swung inwardly and the nut 86 tightened with washer 88 against face 90 of free end 78 and clamp jaw 34. Faces 36 and 38 abut to limit the extent to which the clamp may be closed to avoid crushing of the tubular leg 18.

As can be seen, the interior faces of the clamp jaws of clamps 12 and 14 are adapted to mate or surround and engage the faces of the respective tubular members. With clamp 12, its internal clamp faces 92 are rounded to correspond with the configuration of the circular tubular brace member 16. On the other hand with the clamp 14, its internal faces 94 are irregular, however, designed to engage various portions of the leg exterior to clamp and grip such leg. The shaping of the clamp faces will be discussed in more detail with respect to FIG. 5.

Figure 4:
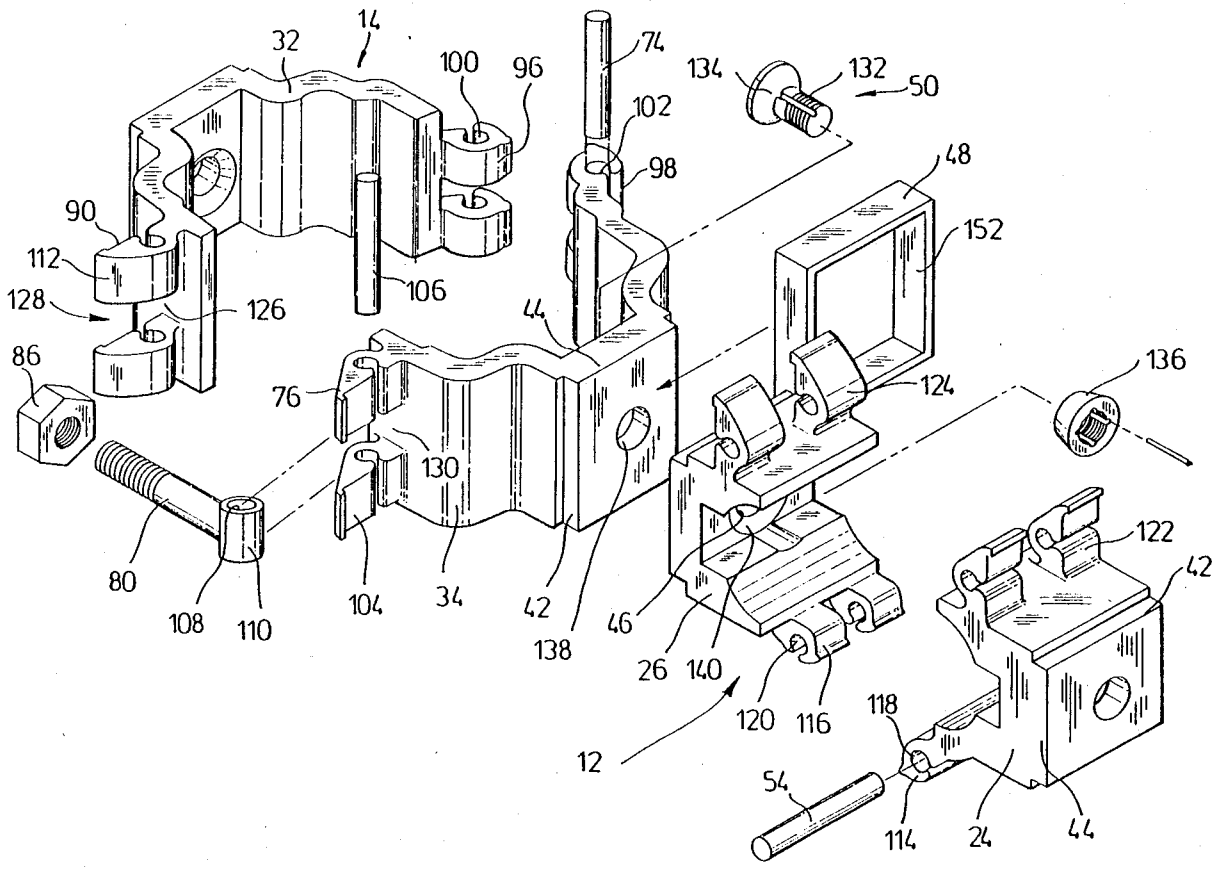
FIG. 4 is an exploded view of the clamp arrangement of FIG. 3

Turning to FIG. 4, the exploded view of the clamps 12 and 14 show the component parts of the clamp arrangement. Referring to the component parts of clamp 14, the clamp jaws 32 and 34 are hinged by way of hinge pin 74. The clamp jaws have formed lug portions 96 and 98 which are offset from one another on clamp jaws 32 and 34 so as to provide a hinge connection when the pin is positioned through aligned apertures 100 and 102 of the respective lug portions.

The bolt 80 is connected to lug portions 104 of the free end 76 of clamp jaw 34 by pin 106 extending through the aperture 108 in the yolk portion 110 of the bolt. This permits the bolt 80 to swing or pivot freely of the free end. Similarly clamp jaw 32 is provided with lugs 112 which provide the faces 90 against which the nut 86 and its washer abut in closing the clamp 14.

With clamp 12, clamp jaws 24 and 26 are interconnected by hinge pin 54. Jaw 24 has lug portions 114 which are offset from lug portions 116 of jaw 26 so as to provide the hinge interconnection where the pin is inserted through the apertures 118 and 120 to be aligned. On the free ends of the clamp jaws 24 and 26 lug portions 122 and 124 are provided to cooperate with the closure device 20 in the manner discussed in respect of FIG. 3.

As can be appreciated from the shapes of the clamp jaws of clamps 12 and 14 there are certain similarities which enable the jaws to be made from e uded sections, particuarly of aluminum alloy. As can b seen with clamp jaws 32 and 34, they are of identical cross section when positioned adjacent one another, where the cross-section is sheared to provide offset lugs 96 and 98 for hinge interconnection. With the lugs 104 and 112, each is provided by removing a central area 126 to define the slot 128 into which the bolt 80 is moved in effecting clamp closure. Similarly with jaw 34, area 130 is cut out to provided space to receive the yoke portion 110 of the bolt 80 for pivotally connecting it to the lugs 104 of the free end 76. Similarly with clamp 12 the clamp jaws 24 and 26 may be fabricated from a length of extruded aluminum alloy having the particular cross-section shown.

According to this preferred embodiment the shoulder faces 42 and 44 are provided between the hinge area and the free end of each clamp jaw. In providing each clamp jaw with these shoulders 42 and 44 and locating them so as to be symmetrical about the axis that each clamp arrangement rotates, then two or more clamps may be interconnected regardless of the configuration for which the particular clamp is configured to engage. Thus for clamp 14 which clamps a frame leg, when it is desired to secure the leg by using two tubular cross braces on each side of the leg, identical clamps 12 may be used one on each side of clamp 14. Thus each clamp jaw is provided with the same matching portions between the jaw's hinge point and free end to facilitate interconnection of two or more clamps. To interconnect adjacent clamp jaws 26 and 34 a connector device generally designated at 50 is used which consists of a threaded bolt 132 having bevelled head 134. A bevelled nut 136 is used to engage the threaded portion of bolt 132. The apertures 46 and 138 of clamp jaws 26 and 34 have their faces bevelled at 140 as shown on aperture 46 to mate with the slopes of bevelled head portion 134 and bevelled nut 136.

Figure 6:
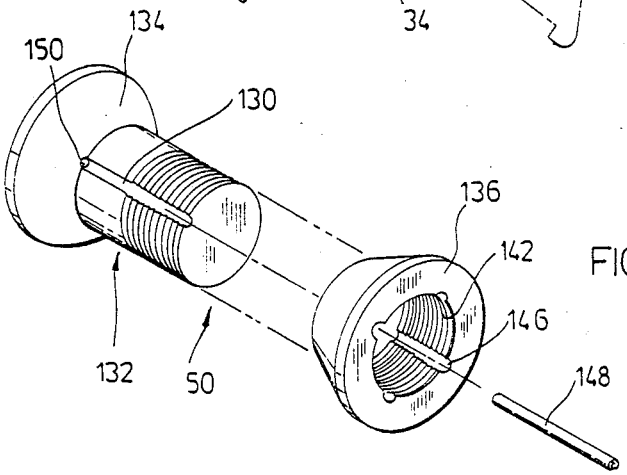
FIG. 6 is an enlarged view of the connector of FIG. 4 for interconnecting clamp members.

The bolt and nut arrangement is shown in more detail in FIG. 6. The threaded portion 132 has an arcuate groove 130 extending parallel to the longitudinal axis of the bolt 50. The bevelled nut 136 has threaded interior portion 142 with four spaced apart arcuate grooves 146. The grooves 130 and 146 adapt the nut and bolt arrangement to provide for locking of the relative positions of the nut and bolt. To lock the relative positions when the nut 136 is threaded on to the bolt to the desired extent, one of arcuate grooves 146 is aligned with groove 130 to define a circular channel into which circular pin 148 is inserted to lock the relative positions of the nut and bolt. The pin 148 may be of the type which is slightly compressed upon insertion into the circular channel so as to frictionally engage surfaces and remain within the nut. The pin can be knooked out by use of a nail or the like as driven through aperture 150 in the bevelled head 134. This nut and bolt arrangement permits interconnection of adjacent clamp jaws 26 and 34 to provide a swivel interconnection without the nut unthreading from the bolt during use of the clamp. The desired degree of frictional engagement between the clamp jaw faces is provided by selecting the appropriate position for the nut on the bolt.

Prior to assembly of clamp jaws 26 and 34, if it is desired to provide for one of the two fixed predetermined positions of the clamps, the collar 48 is placed between the clamp jaws 26 and 34. The collar 48 is placed over the shoulders 42 and 44 of one of the clamp jaws. The remaining clamp jaw is then placed within collar 48 at either the desired 0 or 90 degree relative positions for the clamps. The internal surfaces 152 are all of equal length so as to snugly engage and thereby contain the square outline of shoulders 42 and 44. With the collar in place engaging the matched shoulder portions, the bolt is inserted through aligned apertures 46 and 138 to complete with nut 136 the interconnection of clamp jaws 34 and 26 in the desired fixed relative position.

Figure 5:
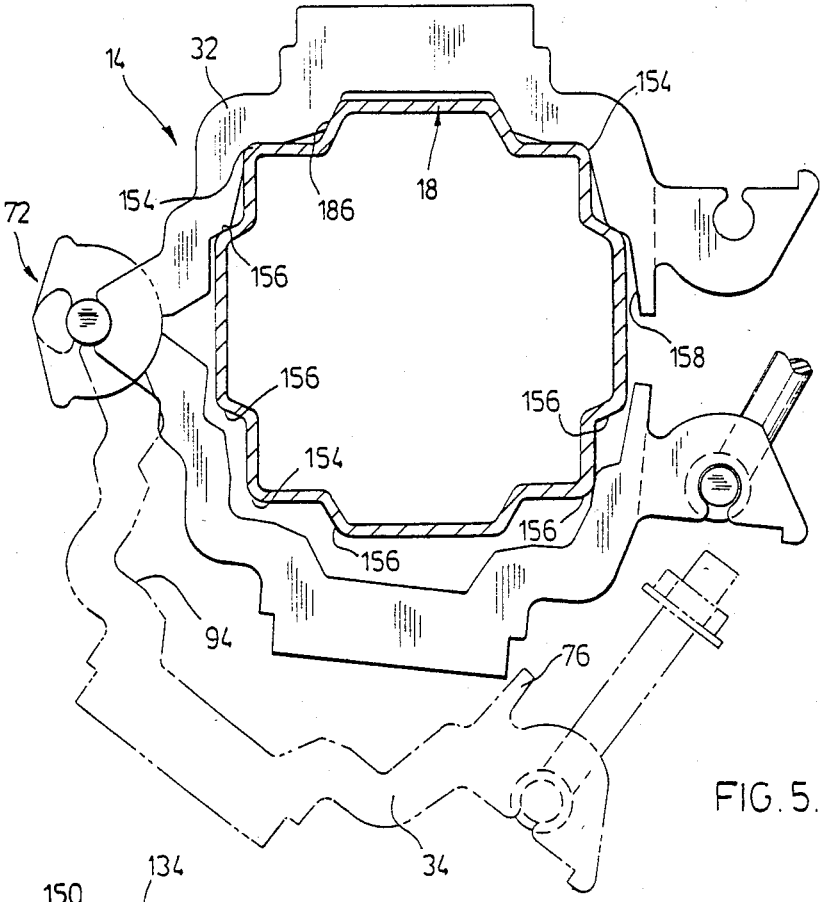
FIG. 5 is a top plan view of the clamp arrangement of FIG. 4 showing various positions in closing the clamp about a tubular member.

Turning to FIG. 5, the frame leg 18 has a particular cross section which enhances its structural strength from a load carrying aspect and also facilitates mechanical connection of cross bracing etc. to the leg. Further details of the leg shape and its purpose are disclosed in co-pending U.S. patent application Ser. No. 249,732. The clamp 14 has its internal surfaces 94 adapted to engage selected portions of the leg exterior about its corner portions 154 and sidewall portions at 156. With clamp jaw 32 positioned against one side of leg 18 the other clamp jaw 34 is pivoted about pivot point 72 where the free end 76 of the clamp jaw clears the leg so that the clamp may be moved towards its closed position and engage all faces of the legs in the areas 154 and 156. To accomplish this the free end 76 is sloped slightly outwardly as indicated at surface 158 so as to clear corner area 154 of the leg as the clamp is being closed.

Figure 7:
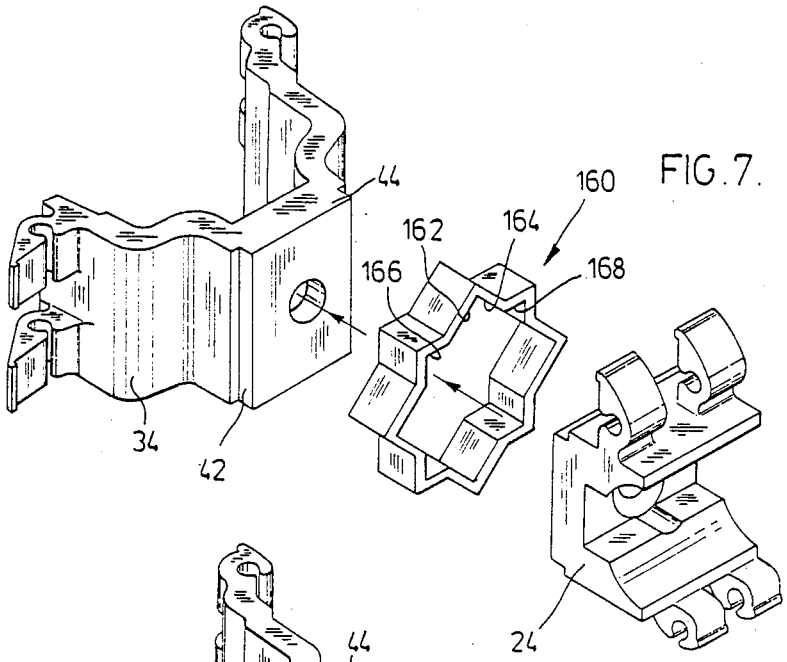
FIG. 7 shows an alternative embodiment of the device for securing clamps in desired predetermined fixed positions.

It can be appreciated, based on the above description of a preferred embodiment of the invention, that several other approaches become apparent in providing for clamp interconnection which gives either unrestricted relative rotation between the clamps or one or more predetermined fixed relative positions. The embodiments of FIGS. 7 through 12 demonstrate variations of the embodiment of FIG. 4 and alternate approaches for the interconnection. FIG. 7 shows the clamp jaws 24 and 34 of the embodiment of FIG. 4, however, a different locking device 160 is used. This configuration for the locking device 160 provides for four distinct fixed relative positions for the clamps, namely 0 degrees, 45 degrees, 90 degrees and 135 degrees. The 180 degree positions etc. around to 360 being duplicates of the above unless distinction should be made with respect to which way the clamp opens relative to the other clamp. To provide for the four distinct positions and using the same matching shoulder configurations 44 and 42, the locking device 160 has a somewhat star-shaped interior. The interior 1s made up of sets of surfaces 162 and 164 which are of equal length and are at 90 degrees relative to one another. Adjacent surfaces 166 and 168 are of the same length only at 135 degrees relative to respective surfaces 162 and 164.

According to the embodiment of FIG. 7 the 0 and 90 degree positions are defined by aligning the shoulders 42 and 44. The collar 160 engages the so aligned surfaces to secure them in position. However, to define the 45 degree and 135 degree relative positions for the clamps the shoulders 42 and 44 are not aligned. Instead their overall outline defines the interior shape for collar 160. Considering this embodiment and the embodiment of FIG. 1 it is apparent that either the aligned shoulders in cooperation with the collar define the desired fixed relative positions or the collar in combination with either aligned or misaligned shoulder positions define other or the same predetermined fixed relative positions for the clamps. Therefore according to this form of interconnection there is a wide variety of fixed relative positions which may be provided by this connection. In situations where it is desired to provide interconnection where the fixed positions are determined by aligned shoulders, it is appreciated that one can begin with three shoulders which are preferably of equal length to define a triangular arrangement for shoulders. The next shoulder arrangements would be a square, pentagon, hexagon, etc. to define respectively, the various relative fixed position for the clamps. To add variation to these basic configurations by misaligned shoulder orientations, a new outline for the collar is provided to secure the desired predetermined fixed position. When misaligning the shoulders a particular collar arrangement can be provided to determine only one fixed position for the arrangement and at all other shoulder relative positions, the collar will not cooperate with the shoulders to define another position.

Figure 8:
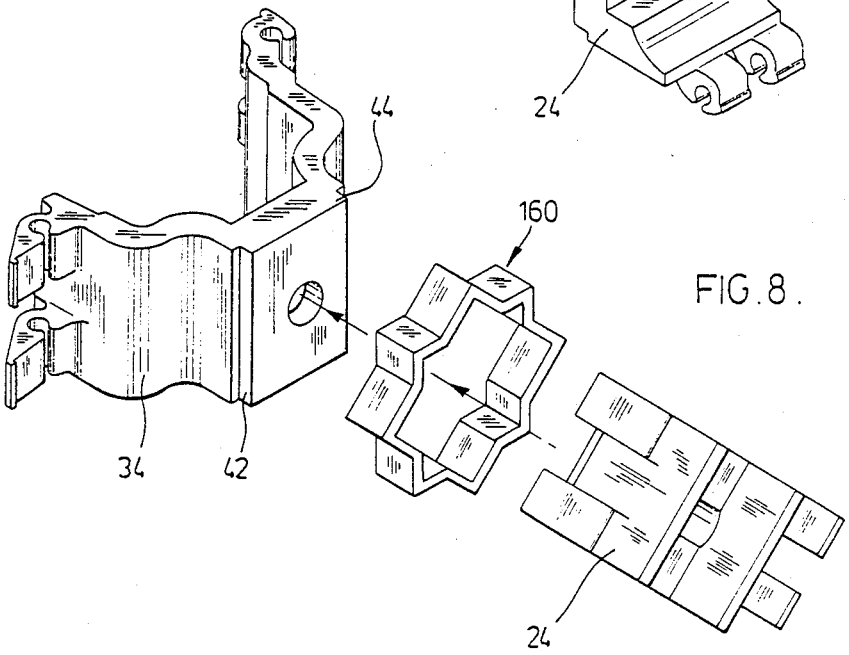
FIG. 8 shows the arrangement of FIG. 7 used to interconnect adjacent clamp jaws in a 45 degree angular position.

FIG. 8 shows the clamp jaw 24 rotated 45 degrees from the 90 degree position of FIG. 7 where the collar 160 is fitted over the now misaligned shoulders 42 and 44 to define the desired 45 or 135 degree relative positioning of the shoulders depending upon which side of the clamp arrangement is viewed. Further with the collar arrangement 160, it is apparent that the 0-45-90 and 135 degree positions are all provided without having to rotate the clamp about the axis of the leg to which the tubular member is to be joined by clamp jaw 24.

Figure 9:
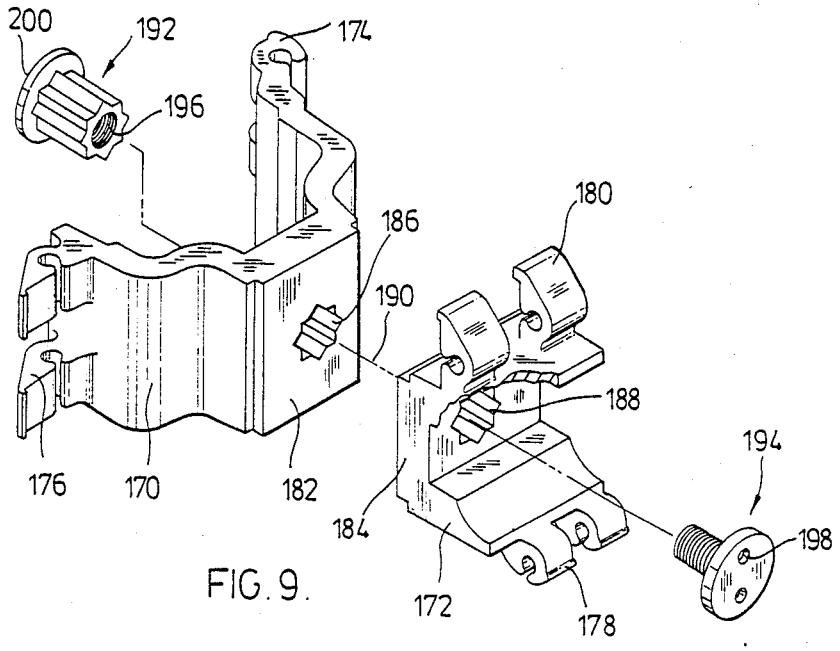
FIG. 9 shows an alternative embodiment for interconnecting adjacent clamp jaws of a clamp arrangement and for providing predetermined fixed relative positions for the clamps.

FIG. 9 shows an alternative form of interconnection for the clamp jaws of adjacent clamps. In terms of the cross section for each clamp jaw it can be seen that it is the same as the section for the clamp jaws of the embodiment of FIG. 1. In FIG. 9, clamp jaw 170 has lug portions 174 for the hinge area and lug portions 176 are provided for the closure device. Similarly with clamp jaw 172 it is provided with lugs 178 for the clamp hinge 180 for the closure device. The body portions 182 and 184 of each clamp jaw have apertures 186 and 188 formed therein. The apertures constitute the matched portions in the area of interconnection of the clamp jaws to provide for the fixed predetermined relative positions for the clamps.

In the instance when it is desired that the clamps be free to swivel relative to one another, a standard bolt and nut may be used for insertion through apertures 186 and 188 along axis 190 to interconnect the clamp jaws for relative rotation. However, when it is desired to secure or lock the jaws in a fixed position relative to one another a special form of nut 192 is used with bolt 194. Each of aperture 186 and 188 has an interior star configuration within each clamp jaw body portion 182 and 184. The interior star configuration in terms of shape is similar to that of the internal shape of collar 160 of the embodiment of FIG. 7. It contains 16 sides all of equal width where the sides are at the angles relative to one another as shown. It can be appreciated that inserting the nut 192 into aperture 186, clamp jaw 172 can be moved relative to nut 192 until the desired angular relationship of 0, 45, 90 or 135 degrees is obtained. Then with the aperture 188 so aligned with nut 192 the nut is slid into aperture 188. To secure the interconnections, bolt 194 is threaded into the internal thread 196 of the nut to make the connection where the bolt head includes apertures 198 into which a special tool is inserted to tighten the bolt in the nut. Bolt 192 also includes a flange portion 200 which abuts the internal surface of the clamp jaw to complete the connection.

Figure 10:
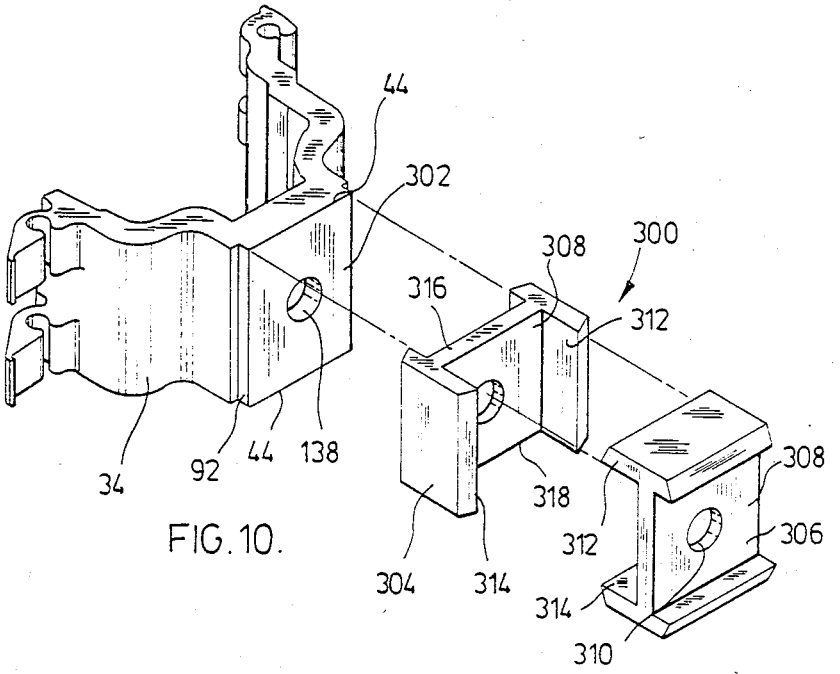
FIG. 10 shows an alternative embodiment for interconnecting adjacent clamp jaws of a clamp arrangement.

Another form of connector for the clamps is shown in FIG. 10. The locking device generally designated 300 is used to fix the positions between the clamp jaws. With this arrangement the locking device is inserted between the clamp jaw faces 302. The locking device comprises two interlocking blocks 304 and 306. The interlocking blocks are identical in cross-section and are somewhat I-shaped. The interconnecting web 308 of each block has an aperture 310 through which the connector bolt extends and which is coincident with aperture 138 in clamp jaw 34. Each block 304 and 306 has spaced apart parallel ridges 312 and 314. The spacing between ridges 312 and 314 is essentially equal to the spacing between faces 316 and 318 of the web 308. This spacing is also equal to the spacing between opposing shoulders 44 of clamp jaw 34. Thus, the internal surfaces of ridges 312 and 314 fit over the surfaces 316 and 318 and also over the opposing shoulders 44 of clamp jaw 34.

Figure 11:
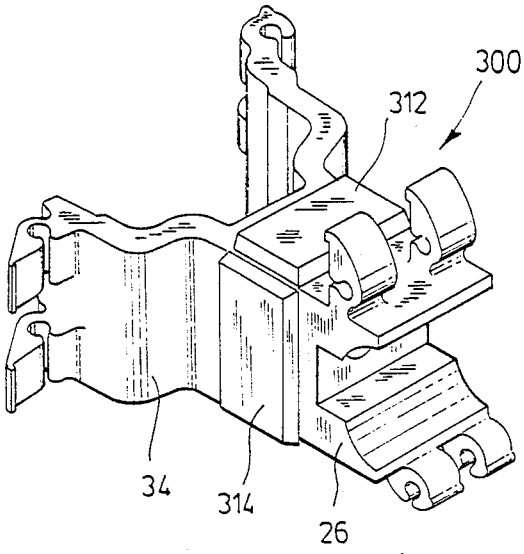
FIG. 11 shows the clamp jaws of a clamp arrangement interconnected by the device of FIG. 10.

With the locking device 300 in interlocked assembled form, and both clamp jaws 26 and 34 connected, the arrangement is shown in FIG. 11. The ridges 312 and 314, as they extend to each side of the web 308, overlap the corresponding shoulders of the interconnected clamps. This arrangement can, therefore, provide two fixed relative positions for the clamps. The reason that the ridges 312 and 314 extend further to one side of the web 308 than to the other side is that the thicknesses of the webs must be accommodated, as the ridges overlap the corresponding shoulders of the interconnected clamp jaws.

From this arrangement, it is appreciated that the locking device insert 300 may consist of a single insert which may be similar to block 304 where the ridges 312 and 314, as they extend to each side of the web 308, overlap the corresponding opposite shoulders, either 42 or 44 of the interconnected clamp jaws.

Figure 12:
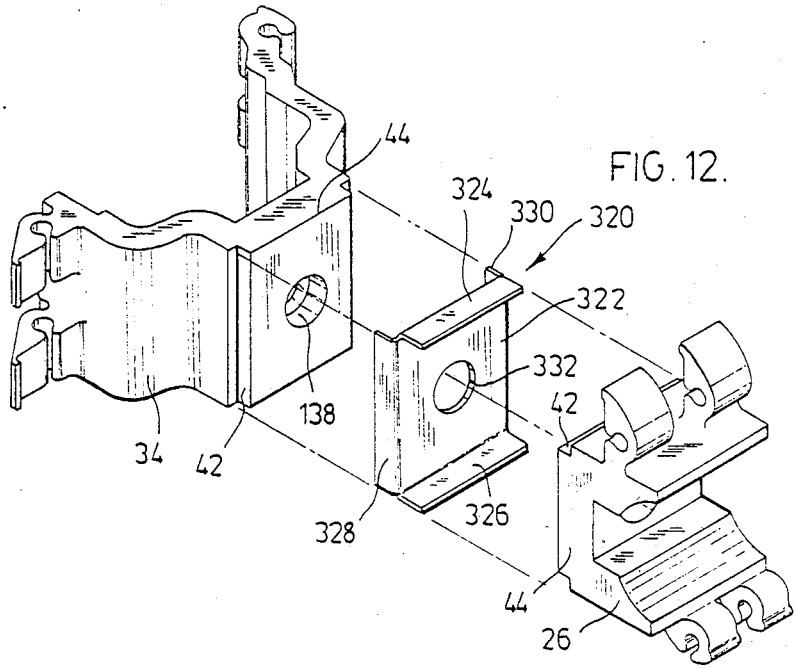
FIG. 12 shows an alternative embodiment for interconnecting adjacent clamp jaws.

A variation of this arrangement is shown in FIG. 12 where the locking insert 320 comprises a plate 322 having two sets of ridges 324, 326 and 328, 330. The plate 322 has an aperture 332 which is aligned with aperture 138 in clamp jaw 34. The spacing between parallel ridges 324, 326 is equal to the distance between opposite shoulders 42 of clamp jaw 26. Similarly, the spacing between ridges 328 and 330 is essentially equal to the distance between opposite shoulders 42 of clamp jaw 34. Thus with the clamp jaws interconnected and the insert therebetween, the two sets of parallel ridges overlap and contain the corresponding clamp shoulders to fix the shoulders in one of two possible positions.

In view of the embodiments shown in FIGS. 1, 7, 9, 10 and 12, it can be appreciated that the invention can be carried out in several forms. The embodiments of FIGS. 1 and 7 rely on a collar or the like which engages the shoulders in the desired relationship to fix their position. In so doing the collar is placed in tension when the clamp is under load. Alternatively with the embodiment of FIG. 9, the nut 192 is placed in shear as located in apertures 186 and 188 when the clamp arrangement is under load.

With either of the embodiments of FIGS. 10 and 12, it is appreciated that the two sets of parallel ridges, such as shown in FIG. 12, may be integrally formed on clamp jaws 26 and 34. As could be appreciated, on shoulders 44 of clamp jaw 34, ridges 324 and 326 could be integrally molded to extend from those surfaces. With clamp jaw 26, ridges 328 and 330 could be formed to extend from the same shoulders 44. Thus, the portions on each clamp jaw, which are to be secured, would be the shoulders 42. This would eliminate the need for locking insert 320. When it is desired to provide for a swivel interconnection between these clamp jaws, a sufficiently thick washer would be placed between the jaws so that the ridges integrally formed on clamp jaws 26 and 34 would not interfere and permit them to bypass one another as the jaws are swivelled relative to one another. This arrangement could also be similarly envisaged with the embodiment of FIG. 10, where the blocks 304 and 306 could be integraly cast or extruded on the respective jaws 26 and 34, so that the ridges would engage in the manner shown. It is appreciated that this arrangement lends itself nicely to extruded forms of clamp jaws, since the parallel ridges on each clamp jaw could be included in the section which is extruded.

A further alternative is that with the embodiment of FIG. 2 and as shown in more detail in FIG. 3. The collar 40 could be integrally cast on either of these clamp jaws 26 or 34. This would define a recess having wall portions of a square outline. These walls would then engage the square outline of the shoulder arrangement provided by shoulders 42 and 44 to make the interconnection. To provide for swivel interconnection, a sufficiently thick washer or spacer would be provided between the clamp jaw faces to ensure that the integrally cast collar or ridge arrangement on one of the clamp jaws is spaced from the shoulders on the other clamp jaw to allow relative rotation of the clamp jaws.

The arrangements are such that, particularly with FIGS. 1, 7 and 10, the stresses exerted on the connecting device are equally distributed about the axis of interconnection of the clamps. This greatly enhances the strength of the clamp interconnection and provides a superior form of clamp for use in heavy-duty application, such as, in shoring frames.

The configuration used for a particular clamp application will depend on the material selection, the number of fixed relative positions desired and the flexibility in changing from a connection which provides for unrestricted rotation to a connection which provides for a predetermined number of fixed relative positions. In addition, the anticipated loads will also determine the configuration used and the thicknesses of the materials for making the interconnection of the clamps.

Figure 13:
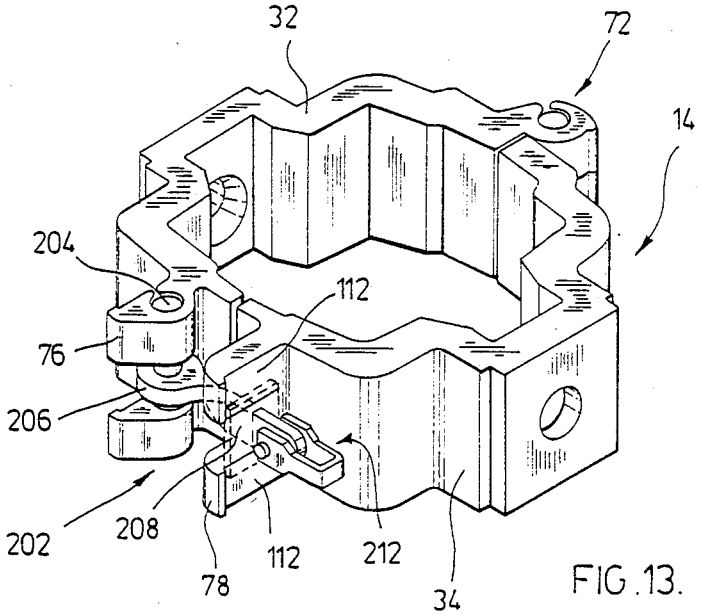
FIG. 13 is a perspective view of a clamp having a cam arrangement for closing the clamp.
Figure 14:
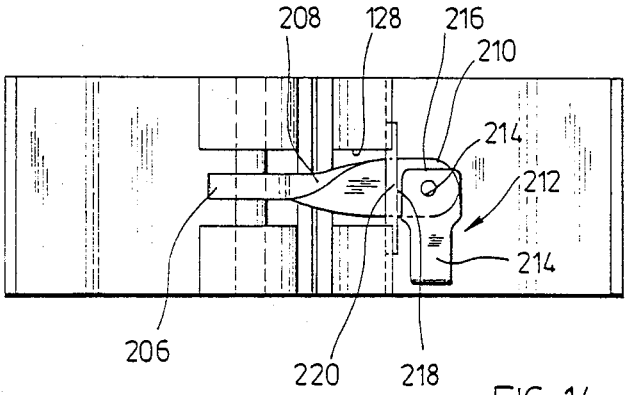
FIG. 14 is a side elevation of the clamp closure device of FIG. 13.

FIGS. 13 through 18 show various configurations for alternative forms of closure devices used in closing the clamps to engage and clamp a structural member. FIG. 13 shows clamp 14 with hinge 72 and closure device 202. The free ends 76 and 78 of the clamp jaws 32 and 34 remain the same. A pin 204 is used to pivotally connect the first end 206 of the arm 208 to clamp jaw free end 76. As shown in FIG. 14, arm 208 of the closure device 202 is twisted 90 degrees so that its free end 210 lies in a plane at 90 degrees relative to the plane in which end 206 lies. Pivotally connected to the end 210 of the arm 208 is a manually operable cam 212 which is pivotally connected at pin 214. The cam 212 comprises a lever 214 and cam faces 216 and 218. Also provided on the arm 208 is a washer 220 which abuts the lugs 112 of clamp jaw 34. With the cam 212 in the position shown in FIG. 13, the washer 220 may be pulled against cam face 216 and the arm 208 pivoted to clear the free end 78 of the clamp jaw. Whether it is desired to close the clamp around a structural member, the arm is pivoted within the slot area 128 between lugs 112 with the washer on the outer surfaces of lugs 112. The cam 212 is then rotated downwardly so as to engage face 218 which is spaced further from pin 214 so as to squeeze the clamp jaws together around the article to be clamped.

Figure 15:
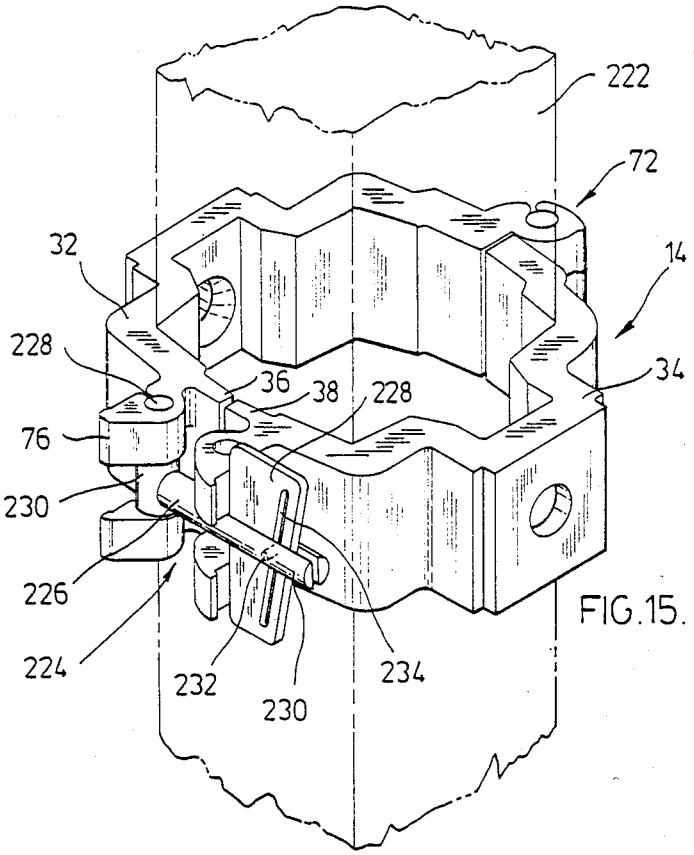
FIG. 15 is a perspective view of a clamp having an alternative embodiment for the clamp closure device.
Figure 16:
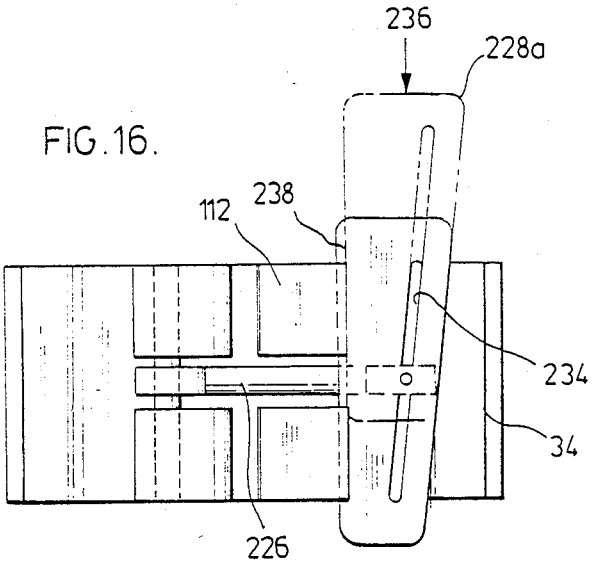
FIG. 16 is a side elevation of the clamp closure device of FIG. 15.

An alternative form for the closure device is shown in FIG. 15 which involves a wedged arrangement. Again the clamp 14 has clamp jaws 32 and 34. The clamp jaws pivot about hinge 72. In this instance the clamp 14 is used to clamp a piece of wood 222. The closure device 224 comprises an arm 226 pivotally connected to jaw free end 76 by pin 228 which passes through yoke portion 230 of bolt 226. On the other end of the arm 226, a wedge 228 is mounted in the split end 230 of the arm and secured in position by a pin 232 which extends through sloped slot 234 of the wedge. As shown in FIG. 16 the wedge in its dotted position **228*a* is spaced outwardly of the lugs 112 of clamp jaw 34 to permit outward swinging of the arm 226 which permits the clamp to be opened or closed. With the clamp closed about the wood, the arm 226 is swung inwardly with the wedge in the upper position 228*a*. With a hammer or the like the wedge is driven downardly in the direction of arrow 236 whereby the sloped slot 234 moves the wedge face 238 inwardly to effect a closure of the clamp. As with the other clamps abutments 36 and 38 are provided to limit the extent to which the clamps are closed. This is particularly helpful with material such as wood because it prevents crushing of the wood when the clamp is connected. Normally the clamps are used so that the wedge 228 is oriented in the manner shown in FIG. 16** thereby relying on gravity to always keep the wedge in its lowermost position. Should the frame to which the clamp is attached be subjected to vibration such orientation prevents accidental loosening of the wedge.

Figure 17:
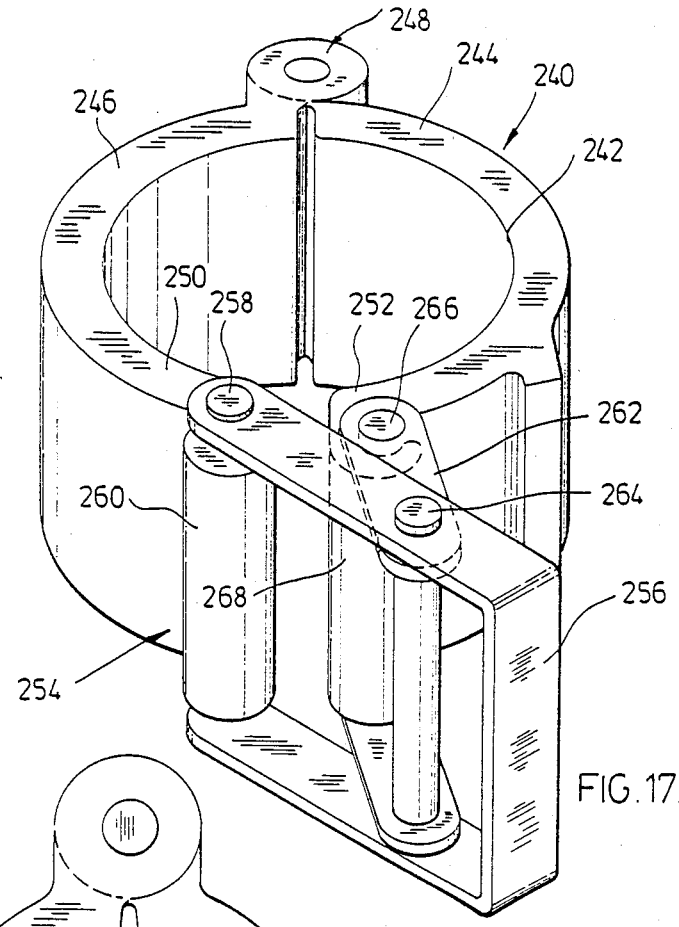
FIG. 17 is a perspective view of an alternative embodiment for the clamp closure device.
Figure 18:
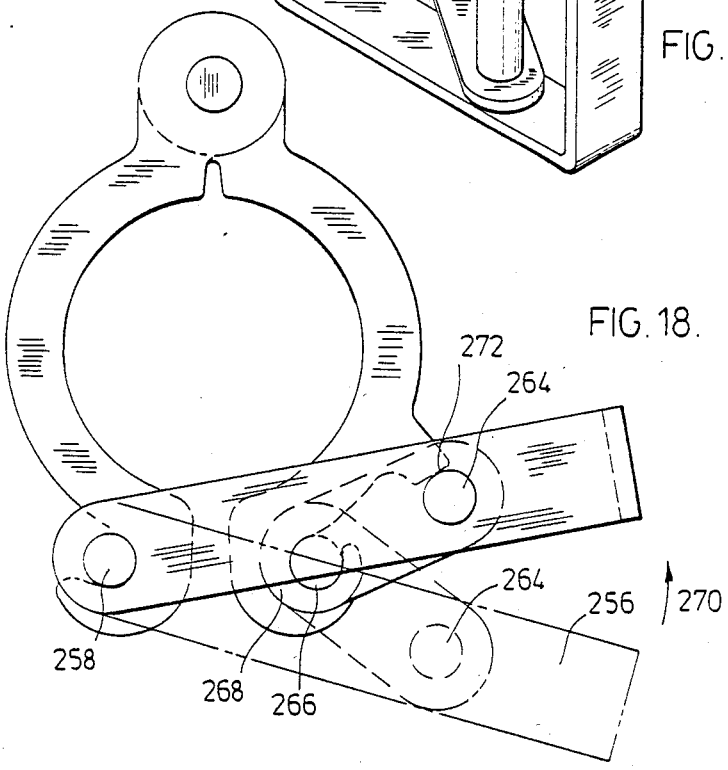
FIG. 18 is a top plan view of the clamp closure device of FIG. 17.

FIG. 17 shows another form of closure device where the clamp 240 has internal face 242 adapted to clamp a circular member. The clamp has jaw portions 244 and 246 which are hinged in area 248. At the free ends 250 and 252 of the clamp jaws, the securement device generally designation at 254 is provided. The securement device operates on the principle of "over-centre" latching of the clamp jaws. The securement or closure device comprises a first U-shaped arm 256 which is pivotally connected at 258 to lug portion 260 of the free end 250 of clamp jaw 246. The closure device also includes a secured arm 262 which is pivotally connected at 264 to the arm 256 in the manner shown and has a rod 266 at the free end of arm 262. The rod 266 mates with lug portion 268. To effect closure of the clamp as shown in FIG. 18, the closure device 254 has the rod portion 266 located in lug 268 with the arm 256 in the position shown. The first arm 256 is moved in the direction of arrow 270 so that the pivot point 264 passes by the alignment of pivot points of rod 266 and of the first arm at 258. As it passes by this centre position, the pivot point 264 moves against stop 272 whereby outward pressure exerted by the structure member clamped, retains the pivot point 264 in its over-centre position against stop 272. This over-centre clamping mechanism can be very effective in applications with require snap action quick closure and quick release.

The clamp arrangement according to this invention provides for many different types of interconnection while retaining the features of unrestricted rotation of the connected clamps or connection in predetermined fixed relative positions for the clamps. The clamps may be formed from extruded aluminum alloy sections to reduce the cost of manufacture and provide for uniformity in making the mating portions in the area of interconnection.

It is also appreciated that in the use of collars and shoulders to define the fixed predetermined positions, the collar need not be formed of a unitary structure. It may be desirable to have a permanent swivel interconnection and when desired to fix them, a collar is used which is openable to surround the aligned shoulders and then closeable to secure them in position. It is also appreciated that other forms of interconnection may be used in providing for relative rotation such as a bearing arrangement which would be symmetrical about the central axis of the interconnected clamp jaws.

The clamps are particularly useable on scaffolding and shoring arrangements and with aluminum structures the clamp jaws may be extruded from aluminum alloy. As explained, this is particularly useful with the arrangements where the locking devices are integrally formed on the clamp jaw, such as, the parallel ridges which function in the manner exemplified in FIG. 12. The jaws may, however, be cast when it is desired to provide irregular surfaces for the matching portions of the clamp jaws.

A further advantage to extruding the clamp jaws is that the length of the jaw can be readily varied dependent upon design considerations. This is useful, for example, when different lengths of jaws are required as determined by the load exerted on the clamp. To prevent slippage of the tightened clamp along the member for a given load, the length of the jaw is selected to provide sufficient clamp surface area to resist slippage of a loaded clamp by way of the frictional engagement of the tightened clamp on the member. In addition, the size of the shoulder arrangement or the like on each clamp jaw may remain the same for each length of clamp jaw to facilitate interchangeability of the clamp jaws.

Although various preferred embodiments of the invention have been described herein in detail it will be understood by those skilled in the art that variations may be made thereto without departing from the spirit of the invention or the scope of the appended claims.

I claim:

1. A clamp arrangement for connecting elongate rigid structural elements comprising two clamps which are capable of being interconnected either for rotation between the two clamps or for positioning of the clamps in at least one predetermined fixed relative position, each clamp having a clamp body which is releasably closeable to surround and clamp a respective structural member, at least one of said clamps in the area of interconnection having at least one portion which is adapted to be secured to position said clamps in said at least one predetermined fixed relative position, and means cooperating with and containing said at least one portion for securing said clamps in said at least one position.

2. A clamp arrangement of claim 1, said clamps in the area of interconnection having opposing portions which are adapted to be secured to position said clamps in said at least one predetermined fixed relative positions, said means being adapted to engage and contain thereby said opposing portions for securing said opposing portions relative to one another at said at least one position.

3. A clamp arrangement of claim 2, wherein said securing means is adapted to balance the distribution of stresses on said securing means about said axis of interconnection when the clamp arrangement is under load.

4. A clamp arrangement of claim 2, wherein said securing means is predominantly under shear when said clamp arrangement is under load and there are forces attempting to rotate the clamps relative to one another.

5. A clamp arrangement of claim 2, wherein said securing means is predominantly under tension when said clamp arrangement is under load and there are forces attempting to rotate the clamps relative to one another.

6. A clamp arrangement of claim 4, wherein said opposing portions have aligned apertures which are symmetrical about said axis, said apertures and said securing means which is adapted for insertion in said apertures having a mating configuration which provides for securing said clamps in the various said predetermined positions.

7. A clamp arrangement of claim 5, wherein said clamps are interconnected along said axis for swivel interconnection, said opposing portions presenting external proximate surfaces, said securing means cooperating with said external proximate surfaces to provide for securing said clamps in the various said predetermined positions, said securing means being placed predominantly under tension by the counter rotation of said external surfaces when said clamp arrangement is plced under load.

8. A clamp arrangement of claim 1, wherein said securing means is integral with said clamps and arranged on each clamp to cooperate with and engage the corresponding opposing portion on the other clamp.

9. A clamp arrangement for connecting elongate rigid structural members comprising two clamps which are capable of being interconnected for either rotation between the two clamps or for positioning of the clamps in at least one predetermined fixed relative position, each clamp having a clamp body which is releasably closeable to surround and clamp a respective structural member, said clamps in the area of their interconnection having opposing portions which have a distinct relative orientation for each said predetermined fixed relative position for said clamps, and means for engaging said opposing portions when they are in each said distinct relative orientation to lock said portions and thereby provide the corresponding fixed relative positions for said clamps.

10. A clamp arrangement of claim 9, wherein said clamps are interconnected for relative rotation about an axis which extends through the longitudinal axes of two elongate structural members connected by said clamp arrangement.

11. A clamp arrangement of claim 10, wherein said locking means balances the distribution of stresses on said locking means about said axis when said clamp arrangement is under load and such stresses attempt to rotate said clamps relative to one another.

12. A clamp arrangement of claim 9, wherein said clamp opposing portions are matched and which have said distinct relative orientation for each said predetermined fixed relative position, said locking means engaging said opposing portions at each distinct relative orientation to secure said clamps in the corresponding fixed relative position.

13. A clamp arrangement of claim 12, wherein said matched portions of the clamps have external surfaces which are symmetrical about said axis, said locking means engaging said surfaces to position said clamps in said corresponding fixed relative position.

14. A clamp arrangement of claim 13, wherein said external surfaces of said matched portions comprise a shoulder arrangement on each clamp body, the shoulder arrangements of interconnected clamps oppose and are similar to one another, said locking means engaging said opposing shoulders when in each distinct relative orientation to position said clamps in a corresponding fixed relative position.

15. A clamp arrangement of claim 14, wherein said shoulder arrangement comprises at least three shoulders all of equal length and are symmetrically arranged about said axis.

16. A clamp arrangement of claim 15, wherein said locking means comprises a collar having an internal shape identical to each clamp shoulder arrangement and dimensioned to snugly receive and overlap opposing clamp shoulders when aligned to position said clamps in the corresponding fixed relative position.

17. A clamp arrangement of claims 15 and 16, wherein said shoulder arrangements comprises four shoulders, said collar having a corresponding square internal shape to provide for two distinct predetermined fixed relative positions for the clamps.

18. A clamp arrangement of claims 15 and 16, wherein said shoulder arrangement comprises four shoulders and said collar has sixteen internal faces all of equal length to provide eight pairs of adjacent faces which are at ninety degrees to one another, such arrangement providing for four distinct predetermined fixed relative positions for the clamps wherein two of those positions said matched portions are aligned and at the remaining two of those positions, said matched portions are not aligned.

19. A clamp arrangement of claim 14, wherein said locking means has an open position to permit placement of said locking means around the adjacent aligned shoulders of interconnected clamps and a closed position for engaging said aligned shoulders of said interconnected clamps to fix them in the corresponding predetermined position.

20. A clamp arrangement of claim 14, wherein connector means releasably interconnects said clamps for relative rotation about an axis, said locking means having a unitary body portion which is engaged with the aligned shoulder arrangements of the clamps prior to completion of clamp interconnection by said releasable connector means.

21. A clamp arrangement of claim 20, wherein said locking means is a collar of unitary structure and having an internal surface configuration to engage the various aligned shoulder arrangements to provide said predetermined fixed relative positions for the clamps.

22. A clamp arrangement of claim 19 wherein each shoulder arrangement comprises four planar surfaces, all of equal length symmetrically arranged about said axis, said collar having a corresponding square internal surface configuration.

23. A clamp arrangement of claim 8, wherein each clamp body has a non-circular aperture therein defined by internal surfaces of said clamp body, such internal surfaces being symmetrical about the longitudinal axis of said aperture, said clamps being interconected with the longitudinal axes of the apertures coincident, said locking means being adapted for insertion in said apertures and bridging same to engage aligned internal surfaces to position said clamps in a corresponding fixed relative position.

24. A clamp arrangement of claim 23, wherein said aperture is defined by at least three internal shoulders all of equal width, said locking means having a cross section with mates with aligned shoulders to fix the relative positions of the clamps.

25. A clamp arrangement of claim 24, wherein said aperture is defined by sixteen shoulders all of equal width and symmetrically arranged about the longitudinal axis of said aperture, said locking means comprising an elongate insert to bridge said apertures, said insert having an external configuration the same as and for engaging the internal configuration of said aperture.

26. A clamp arrangement of claim 12, wherein connector means releasably interconnects said clamps for relative rotation, said connector means comprising means to prevent release of said connector means at least while said clamp arrangement is in use.

27. A clamp arrangement of claim 9, wherein said locking means is integral with said clamps and arranged on each clamp to cooperate with and engage the corresponding opposing portion on the other clamp.

28. A clamp arrangement of claim 27, wherein said locking means comprises at least one ridge integral with each clamp adapted for engaging and thereby containing a corresponding shoulder portion on the other clamp body.

29. A clamp arrangement of claim 28, wherein each clamp comprises parallel external shoulders and parallel external ridges, the spacing between said ridges being essentially equal to the spacing between said shoulders, said ridges being essentially at right angles to said shoulders, said ridges of one clamp engaging the shoulders of the other clamp with the clamps interconnected to provide the corresponding fixed reltaive position for the clamps.

30. A clamp arrangement of claim 29, wherein said clamps are individually formed from an extruded section of aluminum alloy.

31. A clamp arrangement of claim 15, wherein said locking means comprises an insert for positioning between said clamps, said insert having a ridge arrangement adapted to engage said shoulder arrangement of each clamp when in a distinct relative orientation to fix said clamps in the correponding position.

32. A clamp arrangement of claim 31, wherein said insert comprises a plate having two parallel ridges extending in a first direction and two parallel ridges extending in the opposite direction, said shoulder arrangement on each clamp having four shoulders of equal length, the spacing between each set of parallel ridges being essentially equal to the spacing between opposite shoulders of said arrangement.

33. A clamp arrangement of claim 32, wherein the first set of parallel ridges extend essentially at right angles to the second set of parallel ridges.

34. A clamp arrangement of claim 31, wherein said insert comprises two interlocking blocks, each block having means for securing it to a respective clamp and two parallel ridges and two parallel shoulders, the spacing between said shoulders being essentially equal to the spacing between said ridges, said ridges being at essentially right angles to said shoulders, said ridges of one block engaging the shoulders of the other block with said clamps interconnected to provide the corresponding fixed relative position for said clamps.

35. A clamp arrangement of claim 34, wherein connector means for interconnecting said clamps extends along the axis about which the clamps are adapted to rotate, said blocks having apertures through which said connector means extends.

36. A clamp arrangement of claim 1, wherein one of said clamps has at least two portions in the form of an external shoulder arrangement which is adapted to be secured, said securing means being integral with the other of said clamps for cooperating with and containing said shoulder arrangement to secure same.

37. A clamp arrangement of claim 36, wherein said securing means comprises a ridge arrangement adapted to engage and contain said shoulder arrangement.

38. A clamp arrangement of claim 37, wherein said shoulder arrangement comprises four shoulders of equal length to define a square shoulder arrangement, said ridge arrangement defining a square recess having four walls adapted to overlappingly engage said square shoulder arrangement and thereby contain same to provide the corresponding fixed relative position for the clamps.

39. A clamp arrangement of claims 1, 2 or 3 wherein said clamps are adpated to clamp structural members used in bracing scaffolding and shoring frames.

40. A clamp arrangement of claims 9, 27, or 31 wherein said clamps are adapted to clamp structural members used in bracing scaffolding and shoring frames.

41. A clamp arrangement for use with scaffolding and shoring frames comprising at least two clamps, each clamp comprising two clamp jaws pivotally connected together about a hinge point so as to hinge from an open to a closed position for clamping a structural member used in assembling scaffolding and shoring frames, adjacent clamp jaws of said at least two clamps being interconnected for rotation relative to one another about an axis common to all clamp jaws of said arrangement, each clamp jaw having on its exterior between its hinge point and its free end a shoulder arrangement means which is symmetrical about said axis and which cooperates with similar shoulder means arrangement on an adjacent clamp jaw for determining when aligned at least one fixed relative position of adjacent clamps and means for cooperating with and engaging aligned adjacent shoulder means to secure them and thereby provide the corresponding fixed relative position for adjacent clamps.

42. A clamp arrangement of claim 41, wherein connector means symmetrical about said axis interconnects adjacent clamp jaws for relative rotation with said shoulder means arrangements beside each other.

43. A clamp arrangement of claim 41 wherein each shoulder means arrangement comprises at least three shoulders, all of equal length.

44. A clamp arrangement of claim 23, wherein said shoulder means arrangement has four shoulders, each having a planar surface, said securement means being a collar having a square internal shape for bridging aligned shoulders and snugly receiving the shoulders to secure them.

45. A clamp arrangement of claim 44, wherein a connector means is provided for releasably interconnecting adjacent clamp jaws of at least two interconnected clamps, said collar being a unitary structure.

46. A clamp arrangement of claim 41, wherein means is provided for closing said clamp jaws of each clamp to secure a structural member, said closure means cooperating with the free ends of the clamp jaws to effect clamp closure.

47. A clamp arrangement of claim 46, wherein said closure means comprises a bolt pivotally connected to a clamp jaw free end, the mating clamp jaw free end having a slot to receive a portion of said bolt, a nut for threaded engagement with said bolt to secure said clamp on a structural member.

48. A clamp arrangement of claim 46, wherein said closure means comprises an arm pivotally connected to a free end of a clamp jaw, said arm being received by a slot in the free end of the mating clamp jaw, said arm having rotatable cam means for engaging when rotated said mating clamp jaw to effect clamp closure.

49. A clamp arrangement of claim 46, wherein said closure means comprises an arm pivotally connected to a free end of a clamp jaw, said arm being received by a slot in the free end of the mating clamp jaw, said arm having a slidable wedge means for engaging when slid, said mating clamp jaw to effect clamp closure.

50. A clamp arrangement of claim 46 wherein said closure means comprises an over-centre action closure device having a first link arm pivotally connected to a free end of a clamp jaw and a second link arm pivotally connected to said first link arm and for engaging the free end of the mating clamp jaw, the engagement being such that on pivoting said first link arm towards said mating clamp jaw free end with said second link arm engaged therewith, the axis between the pivot points of the first link arm with the clamp jaw and the second link arm pass beyond the point of contact of said second link arm with said mating clamp free end to effect over-centre closure of said clamp.

51. A clamp arrangement of claims 47 and 49, wherein the free ends of mating clamp jaws have opposing abutment portions to limit the extent to which said closure means closes the clamp and thereby precludes crushing a structural member being clamped.

52. A clamp arrangement of claims 1, 9 or 24, wherein said clamps are of aluminum alloy.

53. A clamp arrangement of claims 27, 31 or 41, wherein said clamps are of aluminum alloy.

54. A clamp arrangement of claims 1, 9 or 24, wherein said clamps are individually formed from an extruded section of aluminum alloy.

55. A clamp arrangement of claims 28, 31 or 41, wherein said clamp jaws are individually formed from the same extruded section of aluminum alloy.

* * * * *